US005233922A

United States Patent [19]

Stirbis et al.

[11] Patent Number: 5,233,922

[45] Date of Patent: Aug. 10, 1993

[54] INK FOUNTAIN FOR A CAN COATER

[75] Inventors: James S. Stirbis, Littleton, Colo.; Franklin P. Lee, Orange Park, Fla.

[73] Assignee: Belgium Tool and Die Company, Lynchburg, Va.

[21] Appl. No.: 904,153

[22] Filed: Jun. 25, 1992

Related U.S. Application Data

[62] Division of Ser. No. 638,986, Jan. 10, 1991, Pat. No. 5,148,742.

[51] Int. Cl.[5] ..... B41F 31/04; B41F 31/06

[52] U.S. Cl. ..... 101/363; 101/365

[58] Field of Search ..... 101/363, 364, 365, 350, 101/207, 208, 209, 210, 157, 169

[56] References Cited

U.S. PATENT DOCUMENTS

| | | | |
|---|---|---|---|
| 2,922,364 | 1/1960 | Nitchie et al. | 101/364 |
| 3,404,625 | 10/1968 | White | 101/363 X |
| 4,242,958 | 1/1981 | Jeschke | 101/363 X |
| 4,344,360 | 8/1982 | Jeschke et al. | 101/363 |
| 4,387,648 | 6/1983 | Jeschke et al. | 101/365 |
| 4,402,264 | 9/1983 | Weisgerber | 101/365 |
| 4,414,900 | 11/1983 | Kraus et al. | 101/363 |
| 4,455,938 | 6/1984 | Loudon | 101/363 X |

FOREIGN PATENT DOCUMENTS

| | | | |
|---|---|---|---|
| 2824335 | 12/1978 | Fed. Rep. of Germany | 101/364 |

*Primary Examiner*—J. Reed Fisher

*Attorney, Agent, or Firm*—Mason, Fenwick & Lawrence

[57] ABSTRACT

An offset blanket print/coat assembly for printing or coating rotating containers has a novel inker blade adjustment means which adjusts the fountain blade relative to the fountain roll both inwardly and outwardly, and holds the blade edge in various desired positions along is entire length by the adjustment of individual adjustment threaded shafts positioned along the blade length. Each shaft has spaced apart threaded sections, one of which is more coarsely threaded than the other. One threaded section threadably engages a threaded mounting block mounted to the ink reservoir, while the other threaded section threadably engages a threaded adjusting eye slidably received in a sliding block mounted to the ink reservoir. The adjusting eye is coupled to the blade by a pivotable linkage. In addition, a plastic seal is urged from a slot in each side plate of a inker fountain into direct engagement with the end of the fountain roll and provides a lightweight and secure liquid seal between the seal and the fountain and also between the lower end of the seal and the fountain blade to minimize ink leakage.

7 Claims, 8 Drawing Sheets

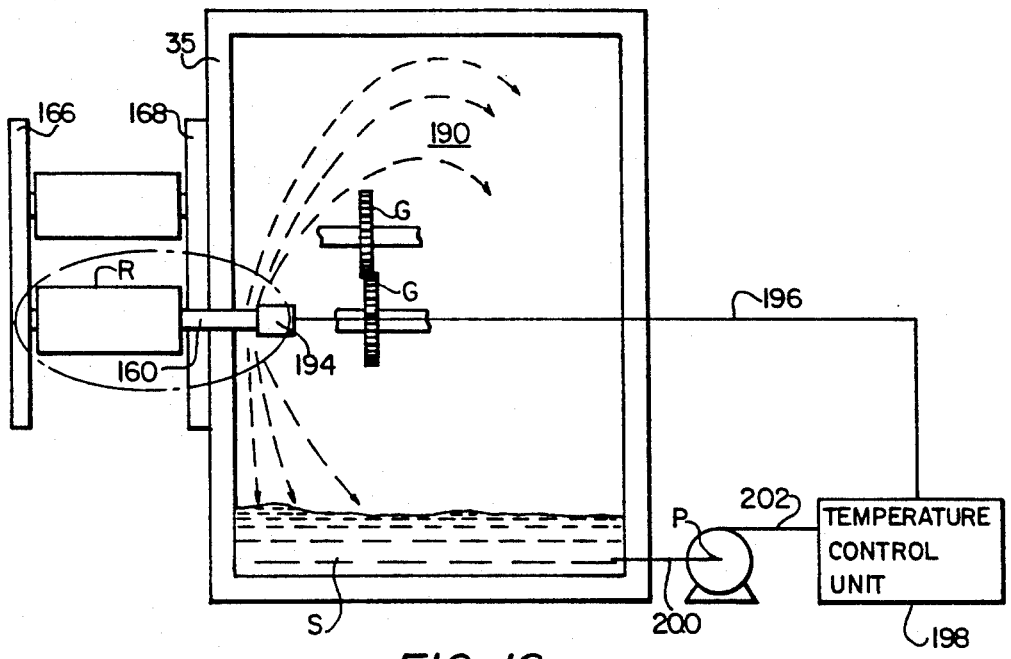
FIG. 12
FIG. 13
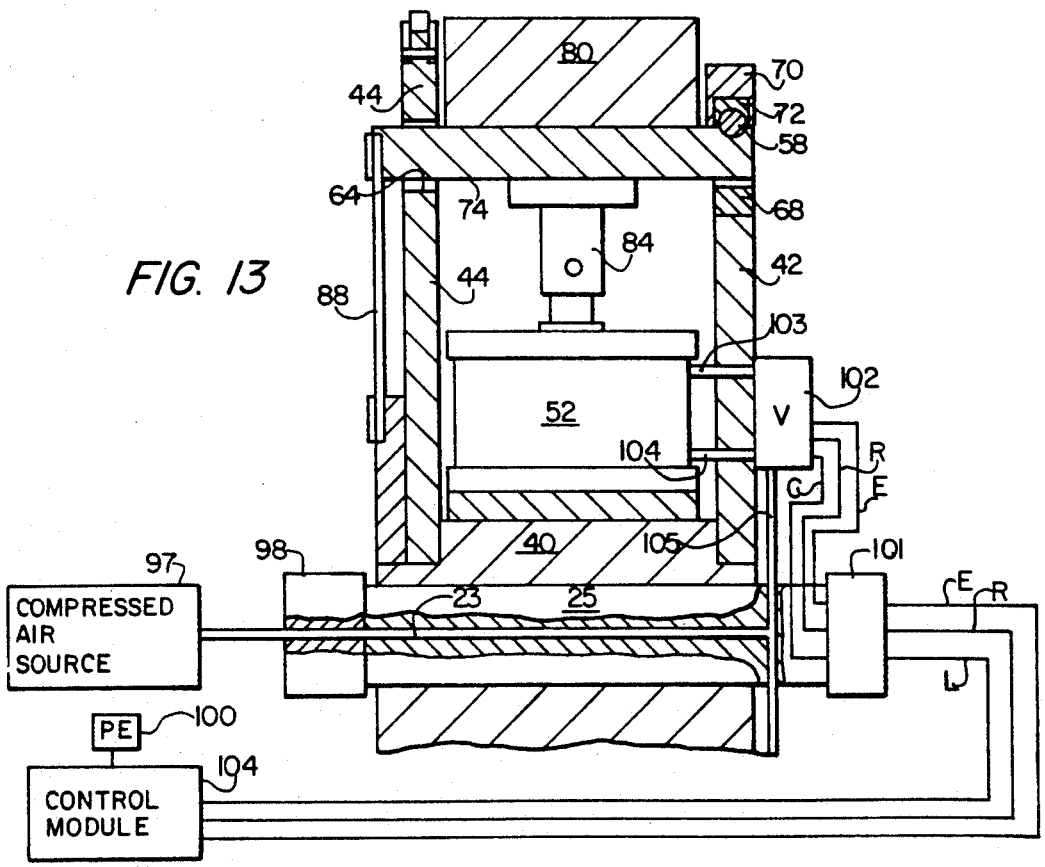

INK FOUNTAIN FOR A CAN COATER

CROSS-REFERENCE TO RELATED APPLICATION

This application is a division of our co-pending application Ser. No. 638,986, filed Jan. 10, 1991, now U.S. Pat. No. 5,148,742.

BACKGROUND OF THE INVENTION

The present invention is in the field of offset printing, decorating or coating of cylindrical objects such as beverage containers formed of aluminum or other material. Even more specifically, the present invention is directed to new and improved apparatus and method for providing a base coat on a container onto which a label-like design providing both aesthetic appeal and information as to the contents of the container is subsequently printed by an offset process. Even more specifically, the subject invention is directed to a new and improved skip-print method and apparatus for preventing contact of an offset blanket with a mandrel on which a container would normally be positioned for receiving ink from the blanket. The prevention of blanket contact with the mandrel occurs in response to the detection of the absence of or mispositioning of a container on the mandrel as the mandrel is being moved upstream of and toward the printing position. Another aspect of the invention is the provision of improved ink fountain roll control means, ink cooling means and ink leakage prevention apparatus.

The beverage container industry has previously employed coating means for coating the exterior of beverage cans fed into position on mandrels mounted on a turret concentrically with respect to the rotational axis of the turret and being equidistantly spaced circumferentially of the turret with respect to each other. Base coating materials employed in providing a base coat to the outer surface of the aluminum or other metal of which the containers are formed have employed rotary devices which receive the coating material from a reservoir and which have rotary roll surfaces for directly applying the paint-like relatively viscous base coat material to the outer surface of the containers as they move into contact with the rotary roll surfaces.

Malfunctions sometimes result from the failure of a container to be positioned on a mandrel or by the mispositioning of a container on a mandrel upstream of the printing or coating location so that when such a fully or partially nude mandrel moves into the printing position, its nude surface is coated with either base coat material or with ink, depending upon the particular operation being performed at that work station. In any event, the result is that subsequent containers positioned on such mandrel are contaminated and must be discarded if the containers are intended for the receipt of a beverage or food product. Moreover, the cleanup of such contaminated mandrel is time consuming and excessively expensive because of down time for the equipment which will normally process hundreds of cans each minute.

Concern with the foregoing problem has resulted in the provision of various devices for preventing the application of base coat material or ink to such a naked mandrel. Generally speaking, such devices use apparatus capable of detecting the absence of a container at a location upstream of the coating o printing station with the detection devices frequently being proximity sensors or photoelectric sensors or the like. Such sensors provide an electrical signal which is used for deactivating the coating or printing means in a variety of ways. For example, such prior known devices have employed means for bodily moving the entire coating or printing apparatus away from the mandrel so that there is no contact with the naked mandrel. Examples of such prior art devices include U.S. Pat. Nos. 4,441,418 and 4,491,613. While devices of the aforementioned type provide satisfactory operation when operated with equipment operating at relatively low speeds, they do not provide satisfactory operation in conjunction with modern high speed equipment due to the substantial amount of mass that must be moved during a deactivation operation and the fact that a large number of cans are lost for each skip-coat or skip-print operation.

Other prior known can printing devices such as that disclosed in U.S. Pat. No. 4,773,326 employ a plurality of blankets mounted on a rotary blanket wheel for pivotal movement about a trip pivot axis oriented parallel to the axis of rotation of the blanket wheel. In such apparatus detection of the absence of a container on a mandrel or the mispositioning of a container on a mandrel results in the deactivation of the blanket member that is approaching the printing position by causing the blanket assembly to be pivoted inwardly about the trip pivot axis so as to avoid contact with the mandrel as the blanket and the mandrel move into printing position. Additionally, the '326 patent also discloses another embodiment in which any empty mandrel is moved radially inwardly on its supporting turret to prevent contact with the printing blanket segment which the mandrel would otherwise contact in the printing station.

The concept of moving a mandrel radially inwardly by the use of complicated apparatus to effect a skip-print operation is also disclosed in U.S. Pat. Nos. 4,037,530 and 4,498,387. Similarly, U.S. Pat. No. 3,665,853 discloses a complicated linkage and cam follower arrangement for pivoting a blanket inwardly about a pivot axis extending parallel to the axis of rotation of the supporting member of the blanket. Similar skip-print means is shown in U.S. Pat. No. 3,563,170 in an offset printer/coater device.

The above-discussed prior art devices all suffer from being complicated, wear prone and expensive to maintain. The pivot shafts and bearings rely upon metal to metal sliding contact which results in wear so that frequent replacement of the wear-prone components is necessary in order to maintain the required accuracy for obtaining satisfactory printing results.

Another problem with prior can coating devices is that they frequently leave a visible color overlap line in the coating material on a can at the location at which the coating applying roller and the can separate at the end of the coating operation. During printing of can surfaces using prior art offset blanket procedures, the cans stay in contact with the blanket until the end of the blanket is reached. Ink on the blanket consequently gets pushed toward the end of the blanket so that there is an ink buildup which remains on the can at the moment of separation to cause a line of more intense color. Until the present time, there has been no way in which the intense color line could be avoided and it has simply been accepted by those of skill in the art. On the other hand, some conventional coaters employ a can positioned in rolling contact with a coating roll with the can being gradually removed from contact with the roll by rotation of the mandrel turret so that the can is gradually moved away from contact with the coating roll without there being an abrupt discontinuation of the application of coating material to the can Consequently, the overlap of the coating material is not as clearly visible as the overlap resultant from printing operations during the decorating of can bodies. The overlap of ink in a decorating operation is quite noticeable and is simply controlled to be about ⅛" wide. The foregoing problems and the use of a variable gravure roller as a proposed solution for some applications are disclosed in detail in U.S. Pat. No. 3,817,209. Other prior art patents have proposed the use of blanket segment sectors having tapered outer ends such as shown in U.S. Pat. Nos. 2,326,850 and 2,442,102. Published Japanese Patent Application No. 61-205 143 discloses coating in which the application roll and the container body are rotated at slightly different speeds to cause "slip" between the container and the roll to improve the coating quality.

Other problems which adversely affect the operation of can decorating equipment and other printing equipment are the problems of ink leakage from fountains and the problem of ink flow control for different equipment operating speeds necessary to achieve required color control for all speeds of operation. More specifically, ink fountains are used to meter the proper amount of ink into the system with the ink being smoothed and leveled and applied to one or more image plates on the plate cylinder in a uniform manner in order for proper operation. The image plates on the plate cylinder normally have a raised image which picks up ink from the inker and then transfers the ink onto the blanket surface in the desired pattern of the raised image. Most existing ink fountains leak excessively and manufacturers have apparently never been able to solve this problem. Most inkers employ side plates which are pressed against the end of the ink roll and an adjustable bottom blade which has an edge extending along the entire length of the roll. The cooperation of the side plates and the adjustable blade results in a space above the adjustable blade and between the side plates which contains the ink which is discharged onto the rotating roll through a very small space between the lower edge of the adjustable blade and the surface of the roll. Most of the adjustable blades are provided with a plurality of mounting screws engageable with the lower surface of such blades for deflecting the blade toward the roll to increase the blade pressure on the roll. Also, the side plates are pushed against the end of the roll in an effort to keep the ink from leaking outwardly beyond the side plates on the end surfaces of the roll. The action of friction between the blades and the roll causes the temperature of the ink to increase so as to reduce its viscosity and make it easier for leakage to occur.

The fountain roll is driven by a common power system with the rest of the printing apparatus so that speeding up of the printing apparatus results in a resultant speeding up of the speed of rotation of the fountain roll. Such an increase in the speed of the fountain roll should desirably result in an increase in the discharge of the ink to the ink train for deposit on the image plate in proportion to the additional ink required for printing the additional cans or other items; for example, if the ink fountain is supplying ink for the printing of cans at 500 cans per minute, an increase in production to 1000 cans per minute should result in a doubling of the amount of ink flow. Unfortunately, prior known devices do not operate in the necessary manner and frequently the ink flow increases more than is necessary due to the fact that the higher rotational speed causes deflection of the adjustable blade by an amount exceeding that necessary to simply keep up with the required increased ink requirements.

It has also been prior practice to employ various water circulation systems for cooling ink rollers in printing equipment. Such systems have been trouble prone and can create messy operating condition due to leaks particularly when the cooling water mixes with lubricants in the system.

Therefore, it is the primary object of the present invention to provide a new and improved can coating or printing apparatus and method.

A further object of the present invention is the provision of a new and improved container coating or printing apparatus having high speed stop-print capability.

Yet another object of the present invention is the provision of a new and improved stop-print offset printing means that is reliable, trouble free and highly accurate.

A further object of the present invention is the provision of a new and improved inker means that has greatly reduced ink leakage as compared to prior art devices.

Yet another object of the present invention is the provision of a new and improved inker blade adjusting means.

Yet another object of the present invention is the provision of a new and improved inker roll cooling means.

SUMMARY OF THE INVENTION

The foregoing and other objects of the invention are achieved by the preferred embodiment of the invention in which a blanket wheel is positioned for rotation on an axis adjacent a conventional mandrel turret which moves containers on mandrels past the blanket wheel through a printing station along an arcuate path centered on the axis of rotation of the blanket wheel. A can detector of conventional design is positioned adjacent the mandrel turret upstream of the printing station and is operable to provide an output signal upon the detection of a bare mandrel on which a can is not positioned or is mis-positioned so as to deactivate the offset blanket on the blanket wheel which would normally print the missing container Activation is achieved in a rapid manner due to the manner in which the blankets are mounted on the wheel and the operation of a quick-acting air cylinder for moving the blanket to an inward position where it cannot contact the mandrel as it moves through the printing station. More specifically, the blankets are provided as part of a blanket segment assembly which is supported on one end by two frame plates oriented in a generally radial direction with respect to the axis of rotation of the blanket wheel and having their inner ends bolted to the wheel hub in a cantilever manner. The blanket assembly is supported on a swing plate attached at one end to the fiberglass spring plates with the swing plate being connected to the rod of an air cylinder extending generally radially on the blanket wheel. The air cylinder is activated upon the detection of a missing container on a mandrel and the rod of the air cylinder applies an inward force to the swing plate which causes the swing plate to move radially inward and to also move in a direction parallel to the axis of rotation of the blanket wheel which latter movement is permitted by bending of the spring plates. Thus, the movement of the blanket to the skip-print position is effected by both radial inward movement and lateral movement axially with respect to the blanket wheel. During normal printing operation the air cylinder is in its extended position and urges the swing plate and the blanket section assembly mounted thereon upwardly with the outer radial position of the swing plate being accurately maintained by a cylindrical socket on a flange of the blanket wheel and a male mating lug o the end of the swing plate which moves into the cylindrical socket to accurately position one end of the swing plate. The opposite end of the swing plate is accurately positioned radially by the two fiberglass spring plates. It is also significant that the cylindrical recess and the cylindrical lug cooperation also very accurately positions the swing plate and the associated blanket assembly axially with respect to the blanket wheel. Thus, the blanket assembly is not positioned by any means such as pivot shafts, rods or bearings which are susceptible to wear and accurate adjustment is always maintained.

A print cylinder is provided for receiving ink from an ink train and transferring the ink to the blanket segments of which there are four such segments on the preferred embodiment of the print wheel. In one embodiment the plates transfer a blank coating to the blanket members for application in coating the outer surfaces of the containers. In operation the blanket segment engages the rotating can on the mandrel and transfers a coat of ink to the outer surface during the first rotation of the can and then transfers a second coat of ink during a second rotation of the ca which continues uninterruptedly following the first rotation. Following completion of the second rotation, the continued movement of the mandrel turret causes the mandrel on which the can is positioned to gradually move outwardly to increase its distance from the axis of rotation of the blanket wheel to gradually terminate the transfer of ink from the blanket to the container so as to avoid an abrupt line on the container indicative of the abrupt termination of application of the ink. Use of the foregoing system permits the containers to be provided with a base coat of ink instead of the more expensive base coat material of the typo previously employed. Consequently, the environmental hazards attendant some of the organic solvent using coating materials is greatly reduced as are the costs of equipment for removing solvent vapors, etc., that would otherwise be necessary.

The inker employed in the preferred embodiment of the invention incorporates an ink fountain having side plates on opposite sides each facing one end of the fountain roll. Each side plate is provided with a slot in which a plastic seal of rectangular cross section is mounted. The plastic seal has one surface which engages the end of the fountain roll facing the seal and compression springs mounted in wells in the slot in which the seal is positioned serve to urge the seal forwardly against the end of the fountain roll to substantially preclude leakage of ink between the end of the fountain roll and the seal. Moreover, the positioning of the seal in the slot in the slide plate largely precludes any leakage of ink between the seal and the side plate. Additionally, the engagement of the seal with the end of the fountain roll causes the fountain roll to exert a small amount of downward pressure on the seal which results in the lower end of the seal being pressed against the upper surface of the fountain blade so as to substantially eliminate leakage between the lower end of the seal and the fountain blade. The friction between the seal and the end surface of the fountain blade is greatly reduced by virtue of the fact that the seal is made of plastic and there is a low coefficient of friction between the steel surface of the roll and the plastic of the seal member. Thus, frictional heating of the roll is substantially reduced.

Heat generated in the ink rolls is also reduced by the employment of a circulating flow of oil from the sump of the gear case through cooling mean from which the cooled oil is pumped to the interiors of the driven steel ink rolls to cool the ink rolls. Oil from the ink rolls flows into the gear case and is sprayed about the interior of the gear case for lubrication and cooling purposes as it moves downwardly in the case to the sump at the bottom of the case. A pump removes the oil from the sump for passage to the cooling means to complete the cycle.

The fountain blade of the inker is provided with pivot arms connected along its lower surface in a line near the edge of the blade facing the fountain roll. Each pivot arm is also mounted on a fixedly positioned pivot shaft extending parallel to the edge of the blade and each pivot arm is connected to a threaded shaft which when rotated moves axially to pivot the pivot arm either in a first direction for urging the blade edge toward the roll or in a reverse direction or pulling that portion of the blade edge to which the pivot arm is connected away from the roll. Thus, each adjustable device is capable of moving the blade edge either toward or away from the roll in a forceful manner and for maintaining the blade edge in the desired adjusted positioned. Since the blade edge is held against any substantial outward movement, increasing the speed rotation of the fountain roll does not deflect the blade edge away from the roll as much as is the case with prior known devices in which there is no restriction upon the outward movement of the roll. Consequently, the ink flow between the blade edge and the roll does not increase as much as it would with the prior art devices and the ink flow merely increases sufficiently to result in the required additional ink flow for the increased number of containers being coated as a consequence of the increase in speed.

It should be understood that the following detailed description and the accompanying drawings merely illustrate the preferred embodiment of the invention and that practice of the invention is not limited to the preferred embodiment since obvious modification not departing from the spirit of the invention will undoubtedly occur to those skilled in the art.

BRIEF DESCRIPTION OF THE DRAWINGS

FIG. 12 is a schematic illustration of the ink roll and gear drive lubricating and cooling system;

FIG. 13 is a schematic illustration of the system for activating and deactivating the blanket for printing and stop-print functions;

DESCRIPTION OF THE PREFERRED EMBODIMENT

Figure 1:
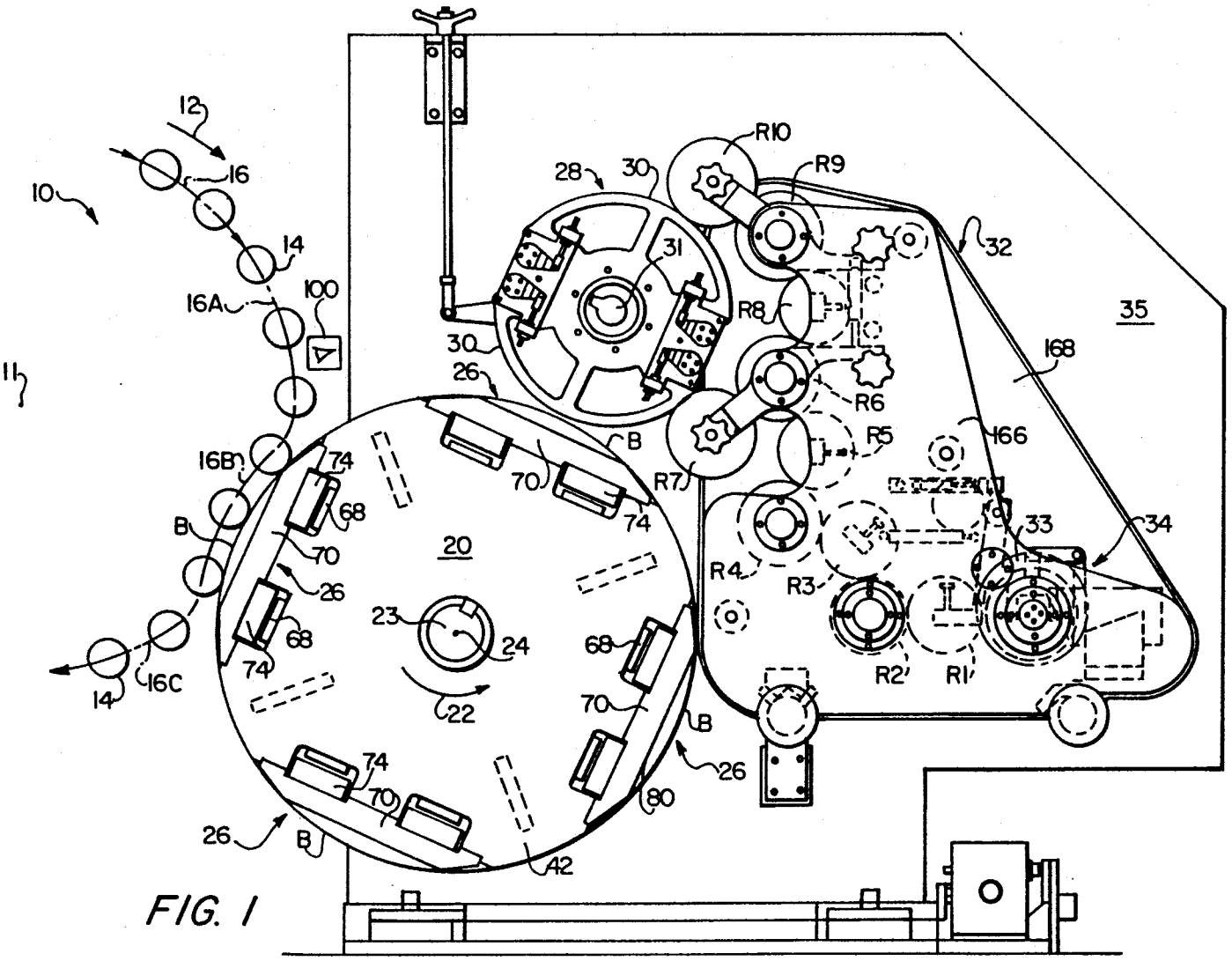
FIG. 1 is a front elevation view of the main components of the preferred embodiment of the invention.

The main components of the invention are illustrated in FIG. 1 and comprise a conventional can mandrel support and drive system 10 including turret means rotating in the direction of arrow 12 to cause cans 14 mounted on the mandrels (not shown) to be coated or decorated.

The can mandrel turret 10 is a conventional Concord model turret manufactured by Ragsdale Machinery Operations of Denver, Colo. The mandrel turret includes a mandrel cam designed to maintain the mandrels for movement along a path which includes an upstream portion 16A of arcuate curvature having a center of curvature coextensive with the axis 11 of rotation of turret 10, portion 16B of reverse arcuate curvature having a center of curvature centered on the axis of rotation 24 of a blanket wheel 20 and a downstream portion of arcuate curvature centered on the axis 11 of rotation of the turret.

The second main component of the preferred embodiment comprises offset printing means which includes a blanket wheel 20 driven for rotation in a direction of arrow 22 about its axis of rotation 24. Four blanket segment assemblies 26 are equidistantly spaced about the periphery of the blanket wheel 20. A conventional plate cylinder 28 having two chrome plated image plates 30 is mounted for rotation about axis 31 to cause the image plates to sequentially contact an outer rubber blanket B (the thickness of which is greatly exaggerated in FIGS. 3 and 4) of each blanket segment assembly as it rotates past the plate cylinder. Each rubber blanket receives ink from a plate 30 for application to cans or containers 14 moving along the reverse curvature print rotation portion can path 16B. Ink is applied to the outer surfaces of plates 30 by a ink roller train 32 which receives ink from steel fountain roll 33 of a unique ink fountain 34 forming part of the present invention and which will be discussed in detail hereinafter. The roller train includes rubber ductor roll R1, steel distribution roll R2, rubber distributor roll R3, steel vibrator roll R4, rubber distributor roll R5, steel vibrator roll R6, rubber form roll R7, rubber distributor roll R8, steel vibrator roll R9 and rubber form roll R10. All rubber rolls are idler rolls and all steel rolls are driven by a gear train in a closed housing having a front wall defined by a portion of front main frame member 35.

Figure 2:
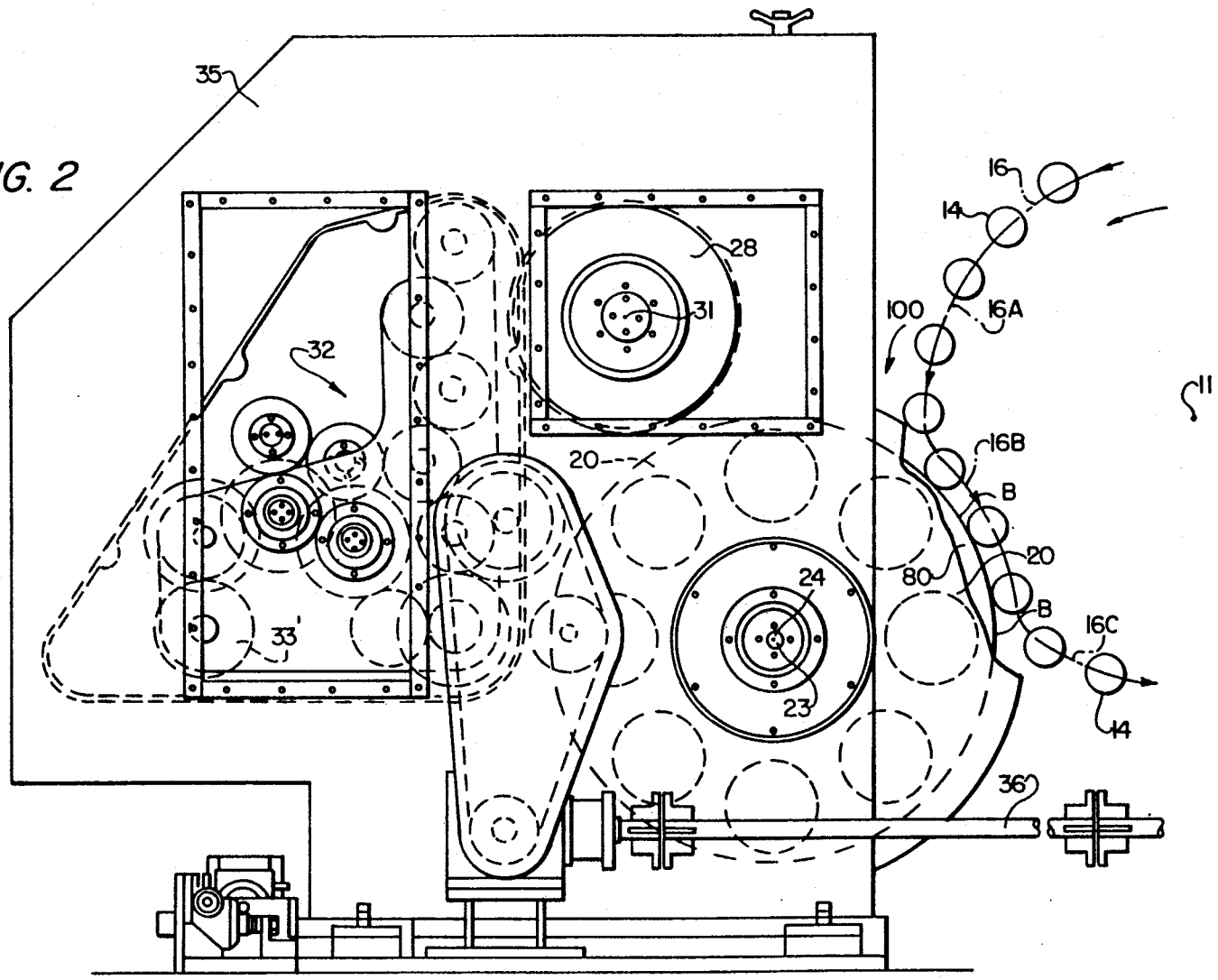
FIG. 2 is a rear elevation view of the main components of the preferred embodiment of the invention.

A main input power shaft 36 (FIG. 2) provides power for driving the blanket wheel 20, the plate cylinder 28, the ink train 32 and the ink fountain 34 in synchronization with turret 10 by means of a gear train operable in a well-known manner.

Figure 4:
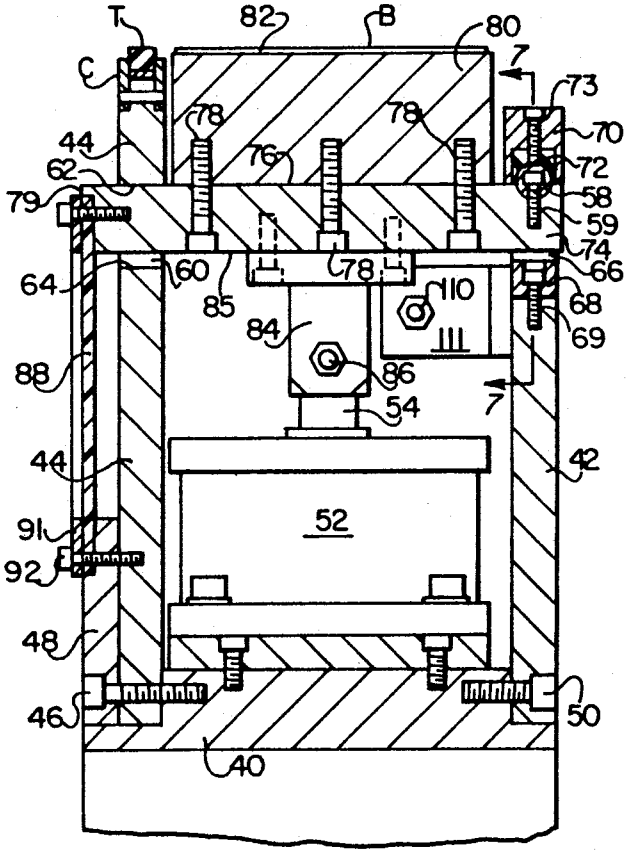
FIG. 4 is a sectional view taken along lines 4—4 of FIG. 3 illustrating the components in an outer or extended printing position.

Details of the blanket wheel assembly will now be discussed with primary reference being directed to FIGS. 3 and 4 of the drawings. The entire assembly is supported on a horizontally oriented main support shaft 23 on which a hub 25 is mounted. The main support shaft 23 and hub 25 are surrounded by a square box frame formed of four bolted together frame plates 40 of equal size and shape and to which a front flange plate 42 (FIG. 4) and a rear flange plate 44 (FIG. 3) ar mounted. Rear flange plate 44 is mounted on the frame plates 40 by threaded connectors 46 which also hold a spring mount plate 48 in position as shown in FIG. 4. Similarly, the front flange plate 42 is held in position by threaded connectors 50 also shown in FIG. 4. Additionally, an air cylinder 52 is provided for each frame plate 40 and each air cylinder is bolted to the outer surface of its respective frame plate 40. Each air cylinder 52 has a piston and rod assembly mounted therein with the piston rod 54 extending in a direction generally radially outward relative to the axis of rotation 24.

Figure 3:
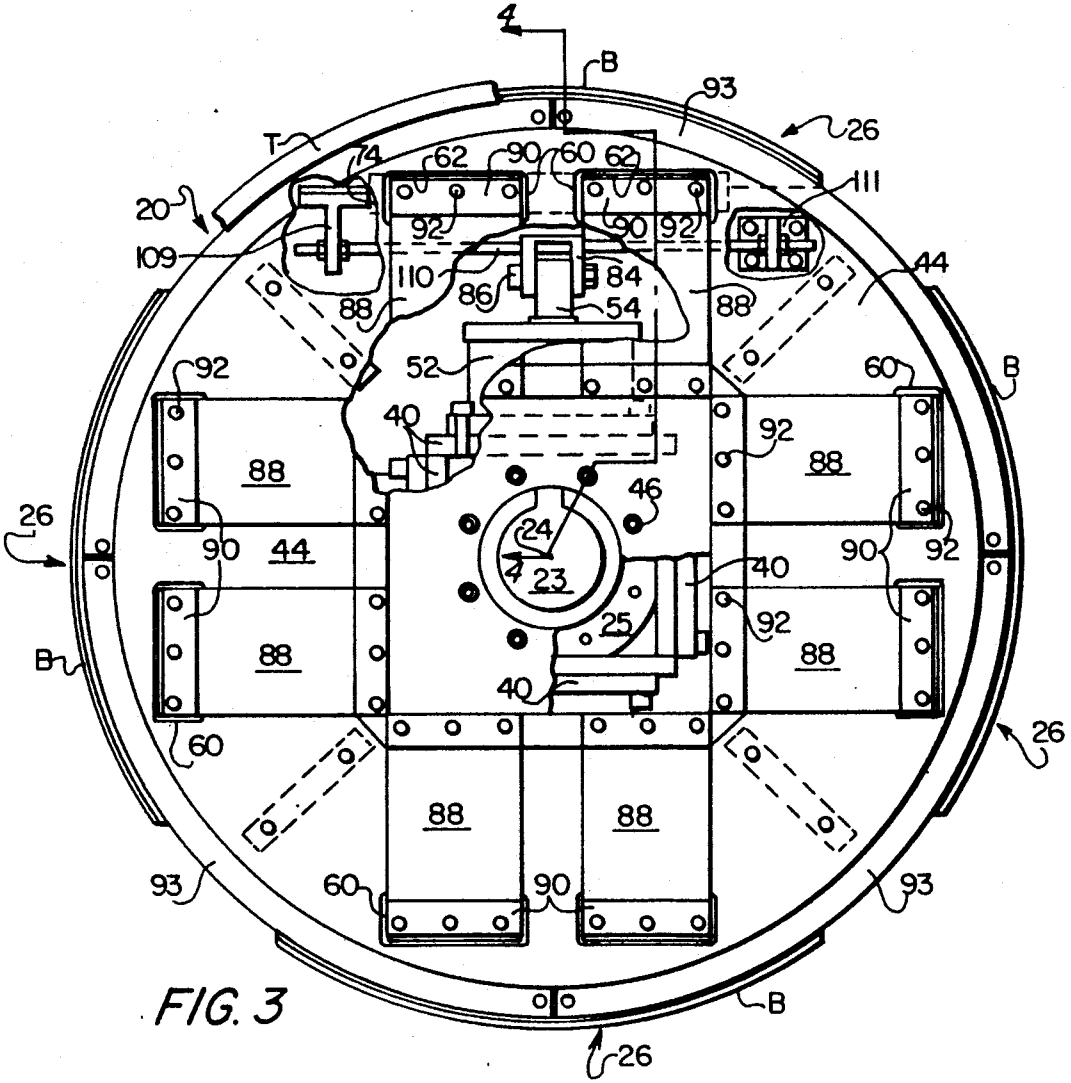
FIG. 3 is an enlarged rear elevation view of the blanket wheel with portions removed for clarity of illustration of the internal components.
Figure 5:
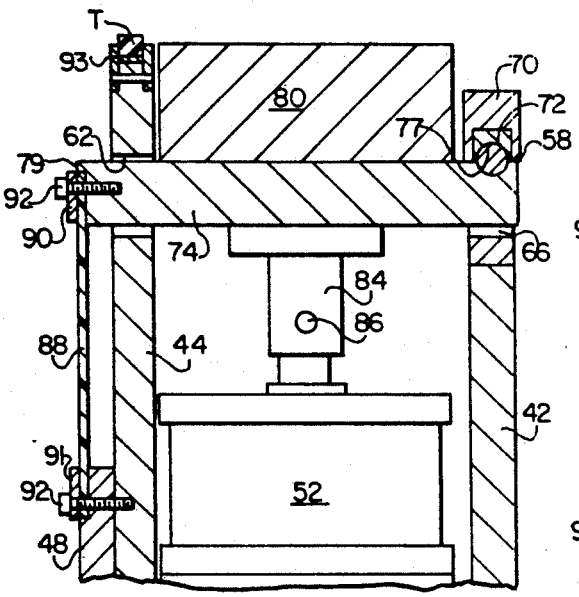
FIG. 5 is a sectional view similar to FIG. 4 illustrating the positioning of the blanket and its supporting components during a normal printing operation.
Figure 6:
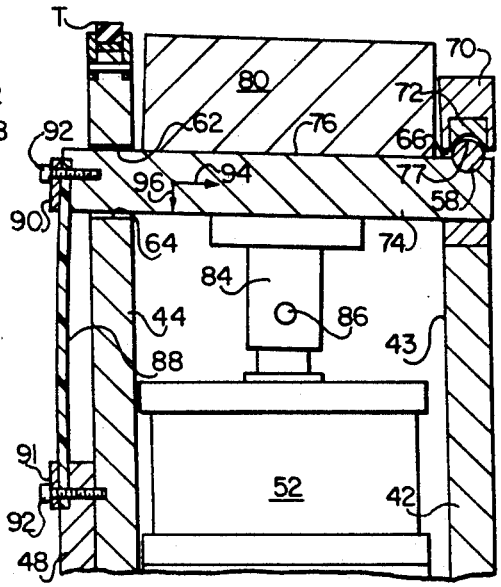
FIG. 6 is a sectional view similar to FIG. 5 but illustrating the blanket and its supporting components in a stop-print inner or retracted position.

Rear flange plate 44 is provided with four sets of two chordally aligned generally rectangular clearance slots 60 defined outwardly (relative to axis 24) by a planar stop surface 62 and inwardly by a planar surface 64 as best shown in FIGS. 3 and 4. Similarly, front flange plate 42 is provided with four sets of rectangular front clearance slots 66 on the inner side of which a down stop pad 68 formed of nylon or other plastic material is provided and held in position by machine screws 69. Similarly, the outer end of each rectangular front clearance slot 66 is defined at its outer extent by a segment stop bar 70 held in position on front flange plate 42 by machine screws 71. A steel stop socket 72 (FIG. 7) is held in an inwardly facing slot in segment stop bar 70 by machine screws 73 and has a downwardly facing cylindrical groove surface (FIGS. 5 and 6).

Figure 7:
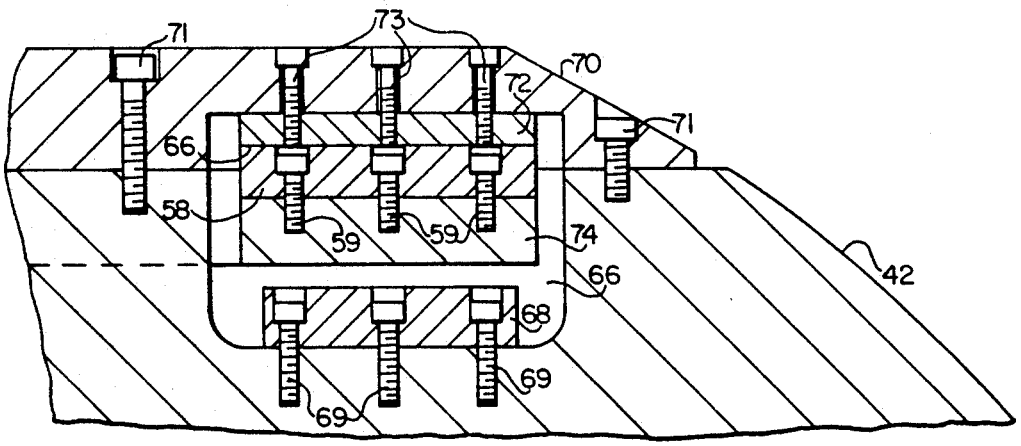
FIG. 7 is a sectional view taken along line 7—7 of FIG. 4.

Each blanket segment assembly includes a swing plate 74 having an outer surface 76 to which a cylindrical stop rod 58 positioned in a mating cylindrical indentation in surface 76 is connected by screws 59 (FIGS. 4 and 7). Plural machine screws 78 (FIG. 4) clamp an aluminum arcuate blanket support block 80 to outer surface 76. The outer surface 82 of arcuate blanket support block 80 is a cylindrical surface having a center of curvature coextensive with the axis of rotation 24 of the main support shaft 23 when the support block 80 is in its outer or print-enable position illustrated in FIG. 4. Rubber blanket B is formed of conventional rubber material used for offset blankets with a thickness in the range of 0.060 inches to 0.080 inches thick and is attached to the outer cylindrical surface 82 by conventional adhesive means. A clevis bracket 84 is connected to the inner surface 85 of swing plate 74 and provides support for pivot means 86 serving to pivotally connect clevis bracket 84 to the outer end of piston rod 54 of cylinder 52.

The rearmost side surface 79 of swing plate 74 is connected to a pair of spring plates 88 formed of fiberglass by clamp plates 90 and machine screws 92. Fiberglass spring plates 88 are preferably formed of the material sold under the trademark SCOTCHPLY by 3M Corporation; however, metal or other material could be used. The inner end of each spring plate 88 is clamped to the spring mount plate 48 by a clamp plate 91 and three machine screws 92. It will consequently be seen from inspection of FIG. 4 that the inner end of each spring plate 88 is attached in a cantilever manner by spring mount plate 48 to the rear flange plate 44 of the blanket wheel assembly and the upper end of the spring plate and the attached swing plate 74 are capable of swinging movement to the right as viewed in the FIG. 4. Such movement to the right is illustrated in FIG. 6 and includes a displacement component 94 parallel to the axis of rotation 24 and also includes an inward radial component 96 (both components are exaggerated in the drawing). Movement of the blanket to the position illustrated in FIG. 6 causes sufficient inward displacement to position the blanket in a position in which it cannot contact a bare mandrel as the blanket is rotated through the printing station. Thus, the inward position of swing plate 74 shown in FIG. 6 constitutes a stop-print position.

The inward movement of the blanket assembly is accomplished by activating the air cylinder 52 to retract piston 54. Such actuation of the cylinder is effected by conventional means in response to the detection of the absence or mispositioning of a can by photoelectric detector means 100 or a similar proximity detector positioned upstream of the printing station as shown in FIG. 1. During normal printing operation, each cylinder 52 is in an activated extend condition as a consequence of the positioning of a double solenoid valve 102. Valve 102 receives compressed air from a source 97, rotary fluid coupling 98 and pressure line 105. Lines 103 and 104 connect valve 102 to the cylinder and selectively receive compressed air or are connected to exhaust to actuate cylinder 52 to either its extend or retract position. When compressed air is provided to line 104, cylinder 52 is extended and the swing plate 74 is urged upwardly into the print position of FIGS. 4, 5 and 7 and the cylindrical stop rod 58 is matingly positioned in the cylindrical cavity defined by cylindrical groove surface 77 in stop pocket 72 so as to accurately position and hold the swing plate and the print blanket in the very precise manner necessary for achieving optimal accuracy during a printing operation.

A stabilizing rod bracket 109 (FIG. 3) is connected to one end of each support block 80 and has one end of a torsion rod 110 fixed to its lower end. The opposite end of torsion rod 110 is fixedly attached to an anchor bracket 111 which is attached to the inner surface 43 (FIG. 6) of front flange 42. The torsion rod 110 etc., serves to permit adjustment and prevent undesirable pivotal movement of blanket support 80 (generally about the axis of rod 110) and to also resist circumferential movement of the blanket support.

It should also be noted that a friction drive ring tire T formed of relatively hard rubber and supported by a foam cushion ring C extends about the outer periphery of rear flange plate 44 and is held in position by four 90 degree clamps 93. The T engages containers and rotates them at a speed equal to the surface speed of blanket B prior to and during their contact with the blanket. Only a portion of tire T is illustrated in FIG. 3 in order to permit illustration of the structure behind the tire.

Spring plates 88 tend to normally retain the swing plate 74 in the position of FIG. 4; however, air cylinder 52 must be activated to its extended position to forcefully hold the swing plate 74 in its upper position during a printing operation to prevent any inward movement of the arcuate blanket support blocks, etc., caused by the force of the printing operation. If photoelectric detector means 100 detects a malfunction, such as a bare mandrel, it provides an output signal to a control module 104 (FIG. 13) incorporating logic circuitry which sends a deactivate signal over the retract signal line R which is connected along with an extend line E and a common line L to the valve 102 of the cylinder and blanket assembly approaching the printing station. The signal is provided through a conventional rotary electric coupling 101 to valve 102 to deactivate the blanket that would contact the bare mandrel in the absence of such deactivation. FIG. 13 illustrates the control arrangement for only on valve and it should be understood that the other valves 102 also have an extend retract and common conductor connected to them through rotary coupling 101 in exactly the same manner shown in FIG. 13.

Figure 8B:
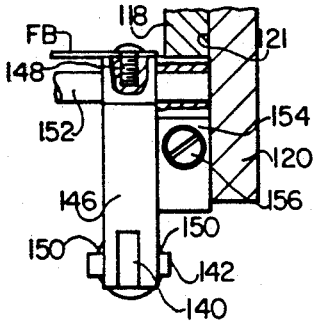
FIG. 8B is a sectional view taken along line 8B—8B of FIG. 8.
Figure 10:
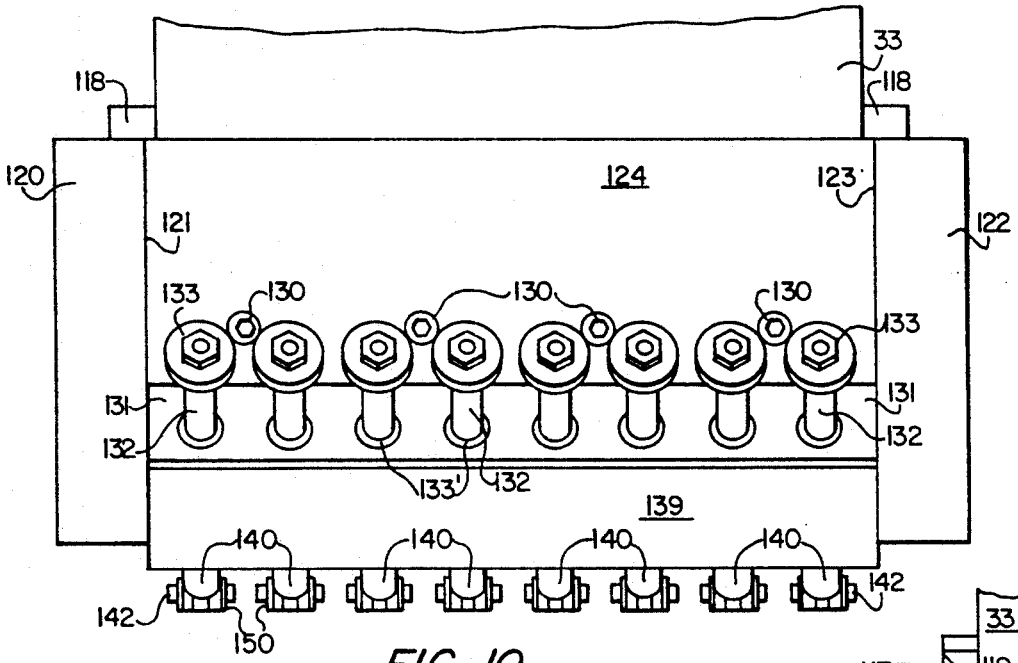
FIG. 10 is a front elevation view of the ink fountain.
Figure 8A:
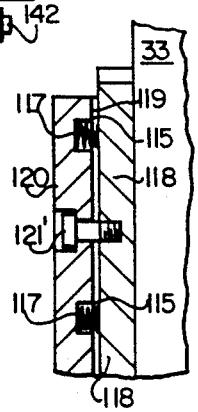
FIG. 8A is a sectional view taken along line 8A—8A of FIG. 8.
Figure 8:
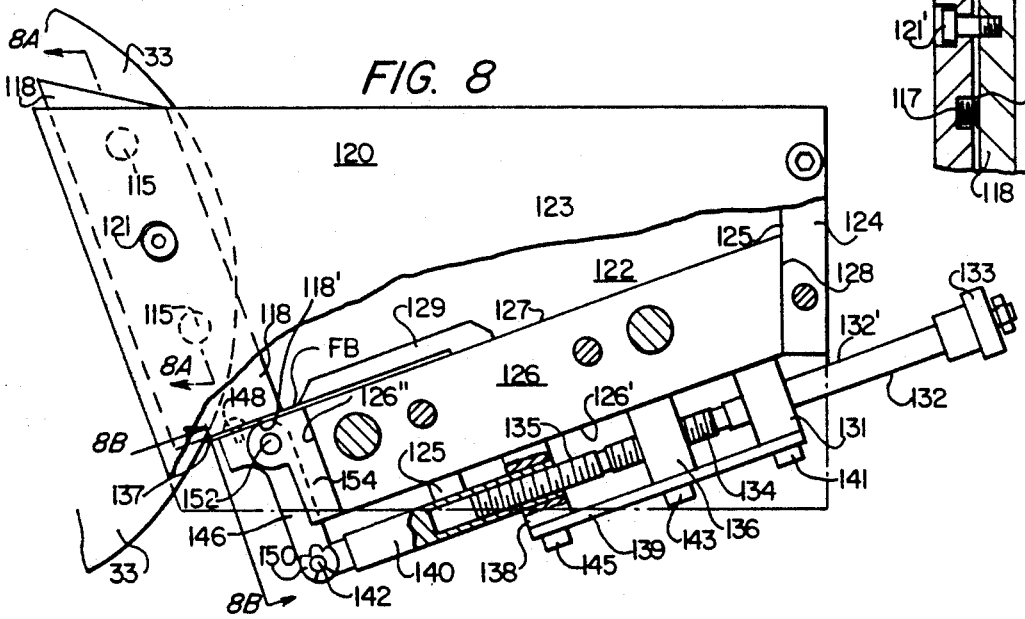
FIG. 8 is a front elevation view, with portions removed for clarity, of the ink fountain.
Figure 9:
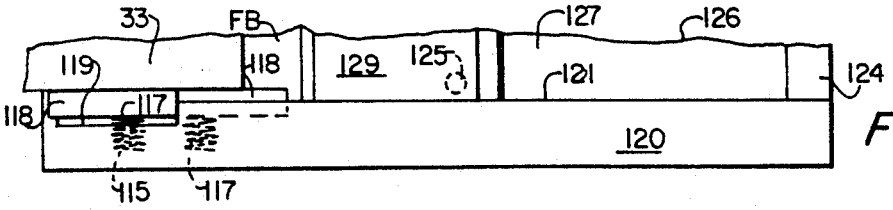
FIG. 9 is a plan view of the front portion of the ink fountain.

Details of the ink fountain assembly will now be discussed with initial reference being made to FIGS. 8 through 10 which illustrate the main components thereof. The main components comprise a relatively thick left side plate 120 and a similar relatively thick right side plate 122 which is a mirror image of the left side plate. A vertically oriented front plate 124 extends between the left side plate 120 and the right side plate 122. A fountain bottom block 126 (FIG. 8) also extends between and is joined to the left side plate 120 and the right side plate 122 and has a forward surface 128 engaged with the rear surface 125 of front plate 124. Machine screws 130 (FIG. 10) securely hold the fountain bottom block plate 126 to the front plate 124 in an obvious manner.

Inner walls 121 and 123 of side plates 120 and 122 respectively define the ends of the ink reservoir, the bottom of which is defined by upper surface 127 of the fountain bottom block plate 126, spring steel fountain blade FB and a blade clamp bar 129. Clamp bar 129 clamps a spring steel fountain blade FB to surface 127 by the action of a plurality of machine screws 125 (FIGS. 8 and 9) extending upwardly through fountain bottom block plate 123 and slots in blade FB and having threaded ends (not shown) received in downwardly facing threaded apertures in the blade clamp. The lower edge 137 of the fountain blade contacts fountain roll 33 in a well known manner. Fountain roll 33 defines the rear extent of the ink reservoir of the fountain.

A steel mounting block 131 is attached to bottom surface 126' of bottom block plate 126 by machine screws 141 and extends across the space between surfaces 121 and 123 and is provided with eight openings through which one of eight rotary blade adjustment shafts 132 extends. A circular dust and liquid seal 133' is provided in each opening and encircles each of the rotary adjustment shafts 132 as shown in FIG. 10. Additionally, a drive knob 133 is provided on the upper end of each rotary adjustment shaft 132. The upper end portion 132' of each shaft 132 is smooth so as to be freely rotatable within the bearing defined by the openings in the seal mounting block 131; however, a relatively coarsely threaded rod section 134 is provided below the smooth surface section of the shaft and a second less coarsely threaded section 135 is provided below the more coarsely threaded section 134. The more coarsely threaded section 134 is threadably engaged in a respective one of eight threaded apertures formed in a thread block 136 attached to the bottom surface 126' by machine screws 143 and extending between surfaces 121 and 123.

A slide bearing block 138 is attached by machine screws 145 to the bottom surface 126' and extends across the space between surfaces 121 and 123 and includes eight smooth-surface bores into each of which an adjusting eye 140 is slidably positioned. The adjusting eye 140 is provided with a threaded internal bore into which the less coarsely threaded section 135 of the rotary adjustment shaft 132 is threadably received as shown in FIG. 8.

The lower end of the adjusting eye 140 includes a transverse bore connected to a pivot pin 142 provided in the lower clevis type fitting of one arm of a fountain pivot 146 having a flat upper surface engaged with the lower surface of the fountain blade FB. A retainer screw 148 (FIG. 8) clamps the fountain blade to the upper surface of the fountain blade pivot 146. Clip members 150 are provided on each end of each of the pivot pins to retain the pivot pins in position.

Each fountain blade pivot 146 is mounted for pivotal movement about a fixed elongated pivot pin 152 extending between surfaces 121 and 123. Elongated pivot pin 152 is supported by a plurality of pivot shaft holders 154 that are connected to the rear surface 126" of the fountain bottom block plate 126 by machine screws 156 (FIG. 8B). A fountain blade pivot 146 etc., is provided for each of the adjustment shafts 132 so that each shaft can be rotated to adjust the edge portion of the blade FB that is adjacent to the respective fountain pivot 146 of that particular shaft. Rotation of shaft 132 causes the adjusting eye 140 to be moved to the left or to the right in a direction opposite movement of shaft 132 resultant from the reaction of the coarsely threaded section 134 with the threads in threaded block 136 and the reaction of threads 135 with eye 140 to effect a finely tunable pivoting of the fountain blade pivot 246 in an obvious manner. Reaction of the more coarsely threaded section 134 with block 136 and the less coarsely threaded section 135 with adjusting eye 140 moves eye 140 in a direction opposite the movement of shaft 132 caused by threads 134 and has the effect of providing a very fine adjustment of the adjusting eye 140 and the fountain blade pivot 146. It is of substantial significance that movement of the adjusting eye 140 to the right as shown in FIG. 8 will operate to pull the edge 137 of the blade normally in contact with the roll 33 away from the roll. Thus, the adjusting system permits adjustment of the lower edge of the blade both toward and away from the roll in varying amounts across the entire width of the lower edge by virtue of the fact that the plural adjusting shafts are connected to the adjusting members extending across the width of the blade. Moreover, the adjusting means tends to hold the blade edge in adjusted position following adjustment. Thus, a very fine adjustment can be achieved A dust seal like seal 133' is provided in slide bearing block 138 for engaging the outer surface of eye 140 and cooperating with a similar seal in block 131 and a lower cover plate 139 to enclose and maintain threads 134, 135 etc., in a clean condition.

Each of the side plates 120, 122 has an inwardly facing seal mounting canted slot 119 extending across and facing an end surface of fountain roll 33. A seal is provided on each end of roll 33 by a side wiper 118 made of any polymeric low friction material capable of providing a good liquid seal against the steel roll 33; one such satisfactory plastic is that sold under the trademark ERTALYTE of Erta N.V., Tielt, Belgium. A side wiper seal 118 is positioned in each slot 119 and is urged against the facing end of roll 33 by coil compression springs 117 mounted in cylindrical wells 115 extending inwardly from the bottom surface 116 of each seal mounting slot 119. The lower end surface 118' of each wiper seal 118 engages the upper surface of fountain blade FB in the manner shown in FIG. 8 and rotation of roll 33 tends to urge the lower end of lower end surface 118' against the blade to enhance its sealing capability.

A loosely positioned retainer screw 121' has its threaded end extending loosely through an elongated slot in side plates 120 and 122 and also has its threaded end threaded into the side wiper 118 at each of the side plates. The head of the retainer screw 121' cannot pass through the smaller opening in the side plate through which its threaded end passes and consequently the head engages the side plate to keep springs 117 from propelling the side wiper 118 inwardly into space when the inker fountain is separated from roll 33.

Figure 11:
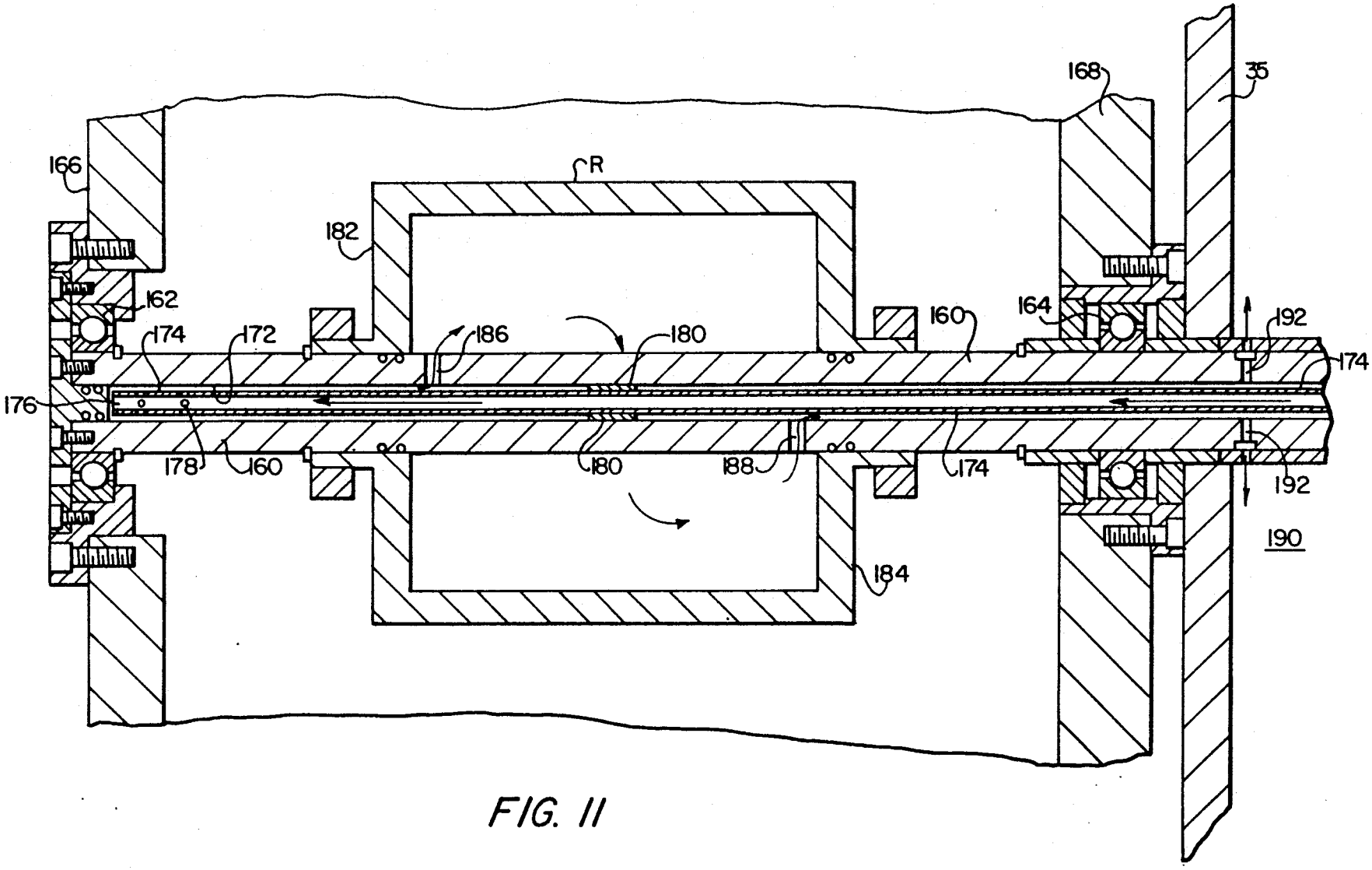
FIG. 11 is a bisecting sectional view through a fountain roll of a typical driven steel ink roll of the ink roll train of the preferred embodiment.

Another significant aspect of the invention resides in the ink temperature control means, the details of which are illustrated in FIGS. 11 and 12. More specifically, the driven inker rolls 33, R2, R4, R6 and R9 are all provided with improved means for permitting the circulation of lubricating and cooling oil internally of such rolls. A typical representative roller R (FIG. 11) illustrates how such rollers is mounted on a hollow shaft 160 between rotary bearings 162 and 164 which are respectively mounted in a front inker plate 166 and a rear inker plate 168 with the rear inker plate 168 being adjacent the main frame member plate 35. Hollow shaft 160 includes an axial bore 172 (FIG. 11) extending along its length. Additionally, an axially aligned tube 174 having an outer diameter less than the diameter of axial bore 172 extends axially along the length of the axial bore 172 as shown in FIG. 11. Tube 174 is open at its forward end 176 and is also provided with a plurality of radial apertures 178. A spacer seal 180 encircles tube 174 at a location between the end wall 182 and 184 of the roll R. An oil supply inlet radial bore 186 extends through hollow shaft 160 and has its inner end communicating with the axial bore 172 and its outer end communicating with the interior of roll R; similarly, an oil discharge radial bore 188 also extends through the wall of the hollow shaft 160 to communicate the interior of the roll R with the cylindrical flow space between the outer surface of tube 174 and radial bore 172 to the right of spacer seal 180.

The portion of hollow shaft 160 positioned to the right of main frame 35 is located in a closed gear case chamber 190 in which the drive gears G for the rolls (only two of which are illustrated) are located. Radial bores 192 extend through the wall of hollow shaft 160 inside the closed gear case chamber. A rotary fluid coupling 194 is mounted on the end of hollow shaft 160 and is connected to the discharge line 196 of a temperature control unit 198 of conventional design.

In operation, shaft 160 is rotated concurrently with the operation of pump P which has a suction line 200 connected with the sump S in the bottom of the closed chamber gear case 190 and a discharge line 202 connected to with the inlet of the temperature control unit 198. Thus, pump P removes oil from the lower end of chamber 190 and passes it through the temperature control unit 198 where the oil will normally be cooled, although in some rare instances, it might be heated. In the following discussion it is assumed that the oil is cooled.

The cooled oil from the temperature control unit goes into the discharge line 196 where it is conveyed through the rotary fluid coupling 194 to enter the interior of tube 174 and flow to the left as shown by the arrows in FIG. 11. The cooled oil flows the length of tube 174 and is discharged through the open end 176 and the radial apertures 178 into the space between the outer surface of tube 174 and inner bore 172 of shaft 160 to the left of the spacer seal 180 as viewed in FIG. 11. The cooled oil consequently flows outwardly through one or more radial apertures 186 into the space within the confines of roller R as shown in FIG. 11. The oil absorbs heat from the roll and the interior of the roll eventually becomes substantially full of oil. The oil is discharged outwardly through radial bore 188 into the space outside the surface of tube 174 and within axial bore 172 to the right of spacer seal 180. This oil is then discharged outwardly to the right and is slung as a spray from the hollow shaft 160 through radial bores 192 into the closed gear case chamber 190 where it engages the surfaces of the gear members and serves to lubricate and cool same as it moves downwardly in the gear case chamber 190 to the sump S from which it is removed by the operation of the pump P. The disclosed lubricating and cooling system has very substantial advantages over prior known systems in which a separate cooler was used for pumping a cooling mixture of rust inhibitor and water through the inker rolls by means of complicated and leak-prone plumbing array.

The fact that the axis 24 of rotation of blanket wheel 20 is lower than the axis of rotation 11 of the infeed turret is advantageous in that it permits the distance between the infeed position of the cans to the turret (which occurs at approximately the 10:30 position) and the detector 100 to be greater than would be the case if the axis of rotation 24 was on the same level as the axis 11B. The reason for the foregoing advantage is that the illustrated positioning gives the containers a greater distance to travel before they reach the detector 100 so that any cans that are slightly mis-positioned have a better opportunity (more time) to become properly positioned on the mandrel.

Figure 14B:
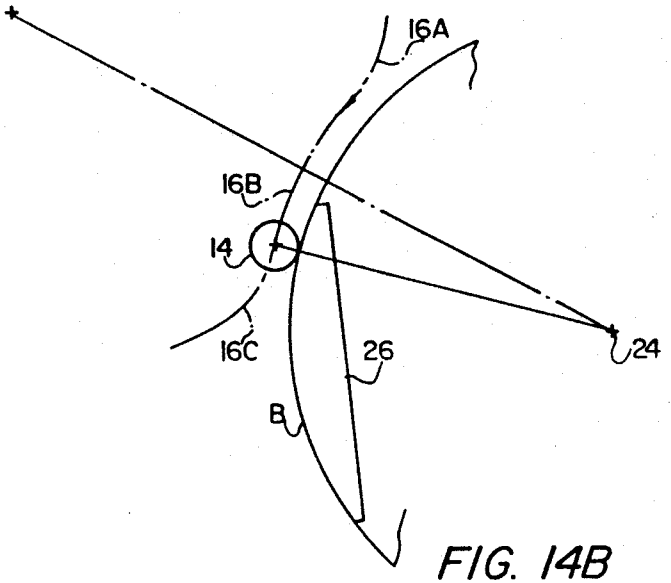
FIG. 14B is a side elevation view similar to FIG. 14A but illustrating the parts in the position near the end of the ink application procedure.
Figure 14C:
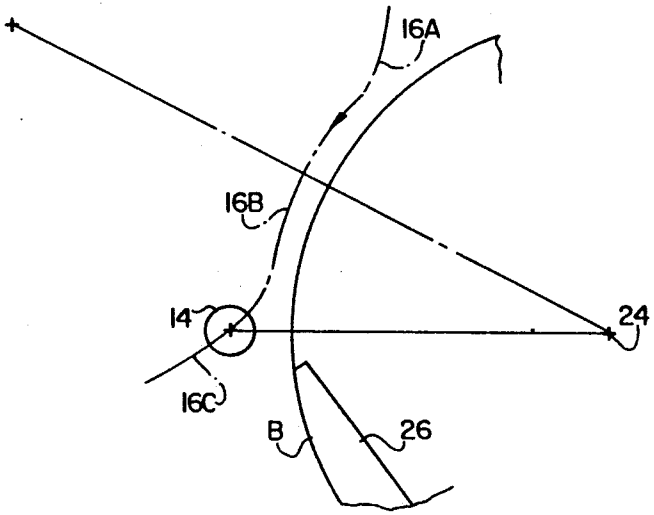
FIG. 14C is similar to FIG. 14A and 14B but illustrates the container and the ink blanket assembly in their positions following separation of the container from the blanket to terminate the procedure.
Figure 14A:
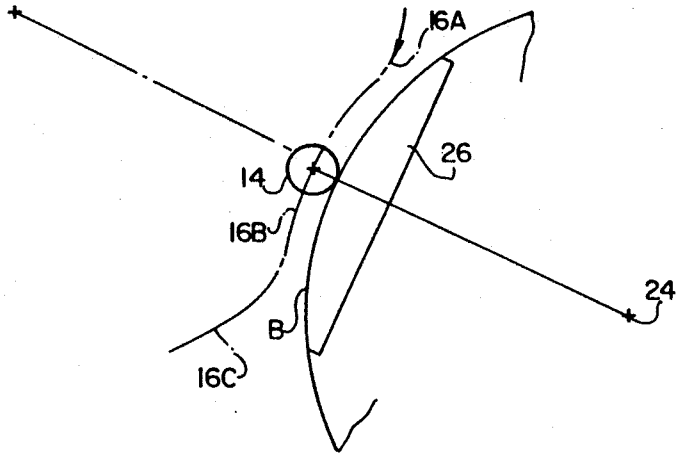
FIG. 14A is a side elevation view illustrating the relationship of the printing blanket to a container receiving ink from the blanket approximately midway through the ink application procedure.

A printing cycle begins as a container leaves the upstream feed path 16A and moves into the transition area between 16A and 16B as shown in FIG. 14A at which point the tire T on the blanket wheel engages the container and quickly brings it to the desired rotational speed matching the surface speed of the blanket prior to contact of the container with the blanket wheel B. After the container reaches the desired rotational speed, which occurs in a fraction of a second, it moves into contact with blanket B and rolls along the surface of the blanket to effect a complete revolution by the time it reaches the area generally shown in FIG. 14A so as to provide a first coating of ink on the outside of the container. The container continues to roll along the blanket for at least one additional rotation so as to apply a second coat of ink to the outside of the container which second coat is basically completed in approximately the position of the container of FIG. 14B. The container then begins to move away from the axis of rotation of the blanket wheel as shown in FIG. 14C so that it moves away from and out of contact with the blanket to avoid the sharp line of ink demarcation that would occur if the container was permitted to roll off the blanket edge.

Numerous modifications of the disclosed embodiments will undoubtedly occur to those skilled in the art; however, the spirit and scope of the invention is not to be limited by the disclosed embodiments but is to be limited solely by the appended claims.

I claim:

1. An ink fountain including:

a fountain roll having planar end surfaces;

a first reservoir side having an inner surface facing one end surface of said fountain roll, said inner surface having a slot formed therein, said slot having a bottom surface facing said one end surface of said fountain roll, and said slot having a plurality of wells extending inwardly from aid bottom surface, each said well having an open end at said bottom surface and a closed end within said first reservoir side;

an elongated plastic seal member positioned in said slot between said inner surface and said planar end surface; and a plurality of coil compression springs, one said spring being positioned in each said well bearing against said elongated plastic seal member to urge said elongated plastic seal member against said planar end surface to prevent any substantial leakage of ink between said elongated plastic seal member and said planar end surface.

2. An ink fountain as recited in claim 1 further comprising a retainer screw having a threaded end extending loosely through said slot and into said elongated plastic seal member.

3. An ink fountain as recited in claim 1 wherein said fountain roll includes a cylindrical surface, and said ink fountain further comprises a flexible fountain blade having an upper surface and free edge positioned adjacent said cylindrical surface of said fountain roll, said elongated plastic seal member having a lower end surface directly engaging said upper surface of said fountain blade.

4. An ink fountain including:

a fountain roll having a cylindrical surface;

partial reservoir defining means cooperating with said fountain roll cylindrical surface for defining an ink reservoir, said ink reservoir having a bottom;

a flexible fountain blade forming part of said bottom of said ink reservoir and including a lower surface and a free edge positioned adjacent said cylindrical surface of said fountain roll to permit the discharge of ink from said ink reservoir between said free edge and said cylindrical surface of said fountain roll; and blade adjustment means for selectively applying force to said blade in a first direction to urge said a portion of said blade free edge toward said cylindrical surface or in a second direction to urge said portion of said blade free edge away from said cylindrical surface, said blade adjustment means including:

a force exerting member including a threaded block attached to said partial reservoir defining means, a slide bearing block spaced apart from said threaded block and attached to said partial reservoir defining means, an internally threaded adjusting eye slidably positioned in said slide bearing block, and a rotary adjustment shaft having spaced-apart first and second threaded sections, said first threaded section threadably engaging said threaded block and said second threaded section threadably engaging said adjusting eye, said threaded shaft being mounted for axial reciprocation in either direction in said threaded block and said adjusting eye in response to rotation about its axis, pivot means, a rocker member pivotably mounted on said pivot means and having first and second parts, said first part of said rocker member being connected to said flexible fountain blade and said second part being connected to said adjusting eye, whereby force applied to said rocker member in a first direction pivots said rocker member and causes said blade free edge to be urged toward cylindrical surface and force applied to said rocker member in a second direction pivots said rocker member in a reverse direction to cause said blade free edge to be urged away from said cylindrical surface.

5. An ink fountain as recited in claim 4, wherein said first threaded section is more coarsely threaded than said second threaded section, and wherein said threaded block and said adjusting eye are correspondingly threaded to threadably engage said first and second threaded sections, respectively.

6. An ink fountain as recited in claim 4 wherein said blade adjustment means comprises a plurality of said rocker members arranged in a row adjacent said free edge and wherein a plurality of force exerting members are individually connected to said second part of one of said rocker members to permit selective positioning of small blade segments along the length of said free edge independently of the position of other portions of said blade free edge.

7. An ink fountain as recited in claim 4 wherein said pivot means comprises a pivot shaft extending substantially parallel to the axis of said fountain roll at a location closely adjacent to said lower surface of said flexible fountain blade.

* * * * *